US008528279B1

(12) United States Patent
Greene, Jr.

(10) Patent No.: US 8,528,279 B1
(45) Date of Patent: Sep. 10, 2013

(54) SECURITY GRILLE AND FRAME

(76) Inventor: James Irvine Greene, Jr., Pulaski, TN (US)

( * ) Notice: Subject to any disclaimer, the term of this patent is extended or adjusted under 35 U.S.C. 154(b) by 0 days.

(21) Appl. No.: 13/429,788

(22) Filed: Mar. 26, 2012

Related U.S. Application Data

(60) Provisional application No. 61/469,264, filed on Mar. 30, 2011.

(51) Int. Cl.
*E06B 3/26* (2006.01)

(52) U.S. Cl.
USPC ..... 52/202; 52/203; 49/55; 49/56

(58) Field of Classification Search
USPC ..... 52/202, 203, 171.1, 126.1, 126.4, 52/126.7, 204.61, 656.5, 656.8; 49/55, 56, 49/254, 257
See application file for complete search history.

(56) References Cited

U.S. PATENT DOCUMENTS

| | | | | | |
|---|---|---|---|---|---|
| 1,438,202 | A | | 12/1922 | Wieland | |
| 1,657,908 | A | * | 1/1928 | Wulftange | 52/507 |
| 1,715,208 | A | * | 5/1929 | Micklin | 52/507 |
| 2,668,729 | A | * | 2/1954 | Watters | 292/137 |
| 2,722,722 | A | | 11/1955 | Mussman | |
| 2,794,217 | A | * | 6/1957 | Croft | 248/200.1 |
| 3,167,828 | A | | 2/1965 | Hutchisson, Jr. | |
| 3,224,048 | A | | 12/1965 | Sullivan | |
| 3,992,833 | A | * | 11/1976 | Hulinsky | 52/206 |
| 3,994,243 | A | * | 11/1976 | Anders | 109/2 |
| 4,000,590 | A | | 1/1977 | Kordewick | |
| 4,059,923 | A | | 11/1977 | Sauer | |
| 4,149,342 | A | | 4/1979 | Bowers | |
| 4,328,649 | A | * | 5/1982 | Sieve | 52/202 |
| 4,384,428 | A | * | 5/1983 | Cox | 49/56 |
| 4,394,805 | A | * | 7/1983 | Napper | 49/55 |
| 4,400,911 | A | | 8/1983 | Bell et al. | |
| 4,437,265 | A | | 3/1984 | Turro et al. | |
| 4,577,438 | A | | 3/1986 | Santiago | |
| 4,604,827 | A | | 8/1986 | Hitchins | |
| 4,653,226 | A | | 3/1987 | Woodrow | |
| 4,671,012 | A | | 6/1987 | Merklinger et al. | |
| 4,679,351 | A | | 7/1987 | Zarlengo et al. | |
| 4,681,354 | A | | 7/1987 | Warwick | |
| 4,745,721 | A | * | 5/1988 | Gartner | 52/745.16 |
| 4,817,334 | A | * | 4/1989 | Badger et al. | 49/55 |
| 4,835,906 | A | | 6/1989 | Collin | |
| 4,848,030 | A | | 7/1989 | Bennett | |
| 4,901,817 | A | | 2/1990 | Carrasco | |
| 4,993,187 | A | * | 2/1991 | Schweiss et al. | 49/56 |
| 5,007,200 | A | | 4/1991 | Londono | |
| 5,012,610 | A | | 5/1991 | Carballo | |

(Continued)

*Primary Examiner* — Brian Glessner
*Assistant Examiner* — Joshua Ihezie
(74) *Attorney, Agent, or Firm* — Steven J. Stark; Miller & Martin PLLC

(57) ABSTRACT

A security grille and frame construction provides a frame which can be connected to a building around a window. The frame preferably provides a front overhang assisting in defining a channel into which the grille is directed at a first side, such as the top. The grille has a second side opposite the first side when installed which has a security fastener with a shaft which can be cut by emergency personnel in the event of an emergency so the grille can be removed from the frame. A reflective exterior surface such as on a spacer may assist in locating the shaft. An adjustable leg may assist in holding the grille during cutting to prevent binding of the cutting tool.

20 Claims, 2 Drawing Sheets

(56) References Cited

U.S. PATENT DOCUMENTS

| | | | | | |
|---|---|---|---|---|---|
| 5,056,262 | A | * | 10/1991 | Schweiss et al. | 49/56 |
| 5,283,976 | A | * | 2/1994 | La Mont | 49/55 |
| 5,335,452 | A | * | 8/1994 | Taylor | 49/463 |
| 5,437,133 | A | * | 8/1995 | Pliml | 52/456 |
| 5,446,996 | A | | 9/1995 | Lamont | |
| 5,487,244 | A | * | 1/1996 | Hill | 52/202 |
| 5,507,118 | A | | 4/1996 | Brown | |
| 5,540,018 | A | * | 7/1996 | Biggers | 52/202 |
| 5,596,849 | A | * | 1/1997 | Hill | 52/202 |
| 5,603,183 | A | | 2/1997 | Giovinazzi | |
| 5,623,791 | A | * | 4/1997 | Schwarz | 52/107 |
| 5,673,883 | A | * | 10/1997 | Figueroa, Jr. | 248/200.1 |
| 5,768,833 | A | * | 6/1998 | Golen | 52/202 |
| 5,787,642 | A | * | 8/1998 | Coyle et al. | 49/61 |
| 5,855,099 | A | * | 1/1999 | Hoffman | 52/202 |
| 5,941,031 | A | * | 8/1999 | Fullwood | 52/202 |
| 5,953,860 | A | * | 9/1999 | Morgan et al. | 49/257 |
| 5,996,292 | A | * | 12/1999 | Hill et al. | 52/202 |
| 6,079,168 | A | * | 6/2000 | Shaver | 52/202 |
| 6,141,912 | A | | 11/2000 | Graham et al. | |
| 6,167,656 | B1 | | 1/2001 | Devlin et al. | |
| 6,189,264 | B1 | * | 2/2001 | DiVeroli | 49/57 |
| 6,209,263 | B1 | * | 4/2001 | Poirier | 49/61 |
| 6,219,978 | B1 | * | 4/2001 | Wood | 52/202 |
| 6,269,597 | B1 | * | 8/2001 | Haas | 52/203 |
| 6,305,124 | B1 | | 10/2001 | Pennington | |
| 6,363,670 | B1 | * | 4/2002 | Dewitt | 52/202 |
| 6,508,039 | B2 | | 1/2003 | Gezelin | |
| 6,820,381 | B1 | * | 11/2004 | Ballough | 52/202 |
| 7,024,820 | B1 | | 4/2006 | Dustin | |
| 7,775,001 | B2 | * | 8/2010 | Milliken et al. | 52/202 |
| 7,827,744 | B2 | * | 11/2010 | Wenrick et al. | 52/202 |
| 7,975,440 | B2 | * | 7/2011 | Motosko et al. | 52/202 |
| 2006/0010792 | A1 | * | 1/2006 | Biggers | 52/202 |
| 2006/0179737 | A1 | * | 8/2006 | Trundle | 52/202 |
| 2007/0101667 | A1 | * | 5/2007 | Sweet et al. | 52/202 |
| 2007/0107328 | A1 | * | 5/2007 | Munch | 52/202 |
| 2008/0016798 | A1 | * | 1/2008 | Miller | 52/202 |
| 2009/0049772 | A1 | * | 2/2009 | Milliken et al. | 52/202 |
| 2009/0288352 | A1 | * | 11/2009 | Wenrick et al. | 52/202 |
| 2011/0010997 | A1 | * | 1/2011 | Kislov | 49/141 |

* cited by examiner

SECURITY GRILLE AND FRAME

CLAIM OF PRIORITY

This application claims the benefit of U.S. Provisional Patent Application No. 61/469,264 filed Mar. 30, 2011.

FIELD OF THE INVENTION

The present invention relates to a security grille and frame system, and more preferably to a frame that is configured to be placed on an exterior of a building external to a window and then provide a security grille within the frame which is preferably both easy to install and then readily removable by emergency personnel, if necessary.

BACKGROUND OF THE INVENTION

Various companies have made security windows and security grilles of various constructions.

However, the applicant believes room for improvement still exists in this area.

SUMMARY OF THE INVENTION

It is a present object of the present invention to provide an improved frame and grille structure for various applications.

It is another object of the present invention to provide a frame and security grille system which, for many embodiments provides security and/or shrapnel protection while still providing relatively ready access for emergency responding personnel.

In accordance with many embodiments of the present invention, a frame is provided as a component which preferably easily installable external to a window. The frame may be constructed principally of angle iron such as on three sides with a channel iron piece at the top which provides a front overhang. The frame may be provided with a series of bores provided for easy connection such as with a quarter inch tress head lag or other fastener such as at predetermined spacing intervals. The front overhang in the top portion preferably cooperates with an upper portion of a security grille to provide a channel into which the top portion of the security grille can be installed into while preventing outward removal at the top of the security grille. The bottom portion of the grille is preferably configured to fit within the bottom portion of the frame and then have adjustable connectors or legs to at least temporarily support the grille internal the frame. Then, connectors like a bolt or other connector such as one insert through a spacer can then connect the grille to the frame such as through a nut tack welded to the frame and grille so it cannot be easily removed. Alternatively, a round bolt head could be utilized externally so there is no grip.

Meanwhile the spacer and possibly reflector material provides a location which may be easy to identify to allow emergency personnel to cut through the bolt in case of emergency so that the grille can then be easily removed relative to the frame for access and/or fire fighting. The legs can support the grille once the connectors are cut to prevent binding on a cutting tool.

The adjustable connectors may at least temporarily support the grille can be adjustable glide bolts or other connectors which may provide an adjustable foot so that the grille can be slid into a desirable position and then the foot extended to contact the bottom frame portion during installation until the more permanent connectors can be installed for security or other purposes as described above.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
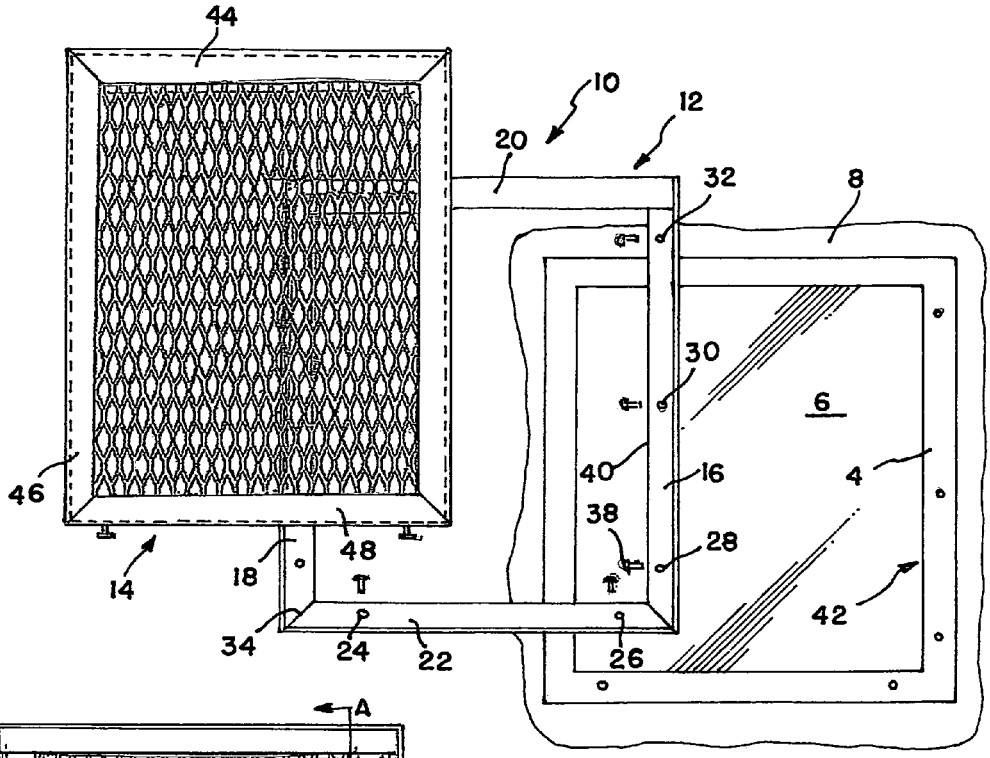
FIG. 1 shows an exploded view of a window frame and security grille combination prior to installing the frame and security grille relative to the window.
Figure 2:
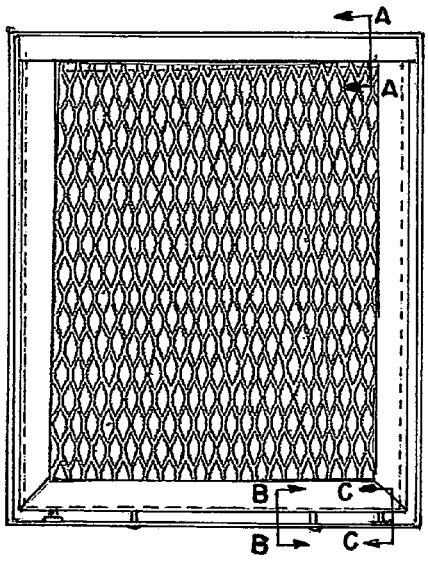
FIG. 2 shows a plan view of the grille installed relative to the frame in an installed configuration.

FIG. 1 shows a portion of a building 8 having a window 6 typically boarded by trim 4. Trim 4, of course, could be a portion of exterior portion of the building 8. Trim 4 is some part of the building 8 external to the transparent material forming window 6 such as glass, plastic or other material.

External to window 6 relative to inside of building 8 is preferably installed the frame and grille system 10 of the presently preferred embodiment. Frame and grille system 10 is comprised of a frame 12 and a grille 14. The frame 12 may be comprised of four frame members such as side members 16,18 which connect to top and bottom members 20,22. Side members 16,18 may be somewhat similarly constructed as bottom member 22 in a preferred embodiment or may be differently constructed in other embodiments. Top member 22 may have a slightly different construction as will be discussed in detail below for at least some embodiments. Lengths and widths may be selected as needed as would be understood by those of ordinary skill in the art.

Side members 16,18 as well as bottom member 22 may be constructed of angle iron type material and preferably provided with a plurality of bores such as spaced apart bores 24,26,28,30,32 which may be at designated locations and/or spacings. While angle iron can be welded such as at corners 34,36 or otherwise as will be understood by those or ordinary skill in the art. In a presently preferred embodiment the angle iron employed is a 2×2×⅛" steel angle. Other embodiments may have other constructions for the side and bottom members 16,18 and 22.

Top member 20 may have a slightly different construction, such as made out of a 2×⅛" channel. The angle and channel members may be steel or other appropriate constructions such as aluminum alloy or other material. Connectors such as connectors 38 illustrated as bolts or other fasteners such as ¼ truss head lags which could be directed through the bores such as bores 24,26,28,30,32 and into the trim 4 or other portion of the building 8 as desired to secure the frame 12 about the window 6. It is preferred that an interior perimeter 40 of frame 12 circumscribe (i.e., completely surround) the exterior perimeter 42 of the transparent member of the window 6 for the preferred embodiment. Other embodiments may have other constructions.

After installing the frame 12 to the trim 4, the grille 14 may be installed relative to the frame 12. Specifically, as may be better seen with reference to FIGS. 1 and 3, the grille 14 may be comprised of edge members 44,46,48,50. The edge members can be any particular size as desired to fit in the frame 12. It is understood that the frame members 16,18,20,22 and edge members 44,46,48,50 can be any size to accommodate the window 6.

Figure 3:
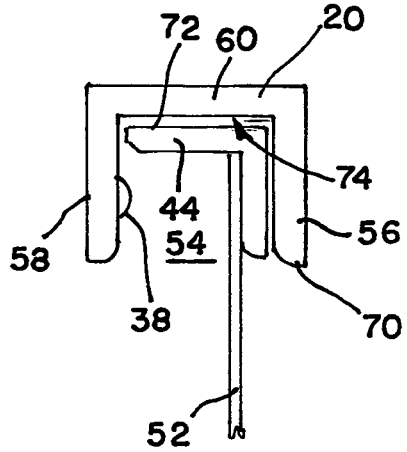
FIG. 3 shows a cross-sectional view taken along line A-A of FIG. 2.
Figure 4:
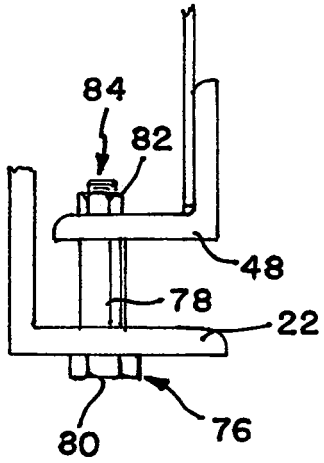
FIG. 4 shows a cross-sectional view taken along line B-B of FIG. 2.

Many of the frame members 16,18,20,22 could be made of angle iron and/or channel iron such as shown in FIG. 3 which can be welded to a mesh 52 so that the mesh provides at least one of a security and/or safety barrier possibly together with the edge members 46,48,50,52.

The mesh 52 may be a ¾×9 expanded metal mesh or other appropriate structure. As can be seen from FIG. 3, the upper edge member 44 can be inserted in the channel 54 as defined by the downwardly extending legs 56,58 which downwardly extend relative to cross members 60 of the top member 20 forming the frame 12. The exterior downward leg 56 preferably prevents outward removal of at least a portion of the upper edge member 44.

Figure 5:
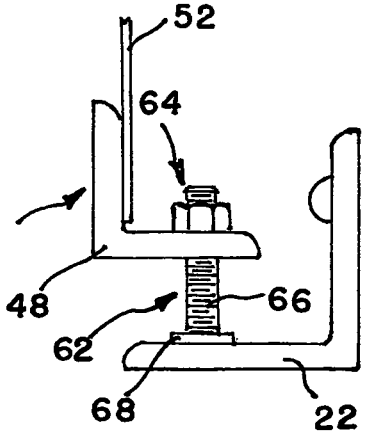
FIG. 5 shows a detailed cross-sectional view taken along line C-C of FIG. 2.

In order to secure the bottom portion of the grille 14 to the frame 12, the applicant provides what is believed to be a unique configuration. Specifically, as shown in FIG. 5, an adjustable glide bolt 62 may be employed which is received within nut 64 and the threads 66 can allow the foot 68 to be moved upwardly or downwardly as it is rotated relative to nut 64. The nut 64 may be welded to the bottom edge member 48 until the foot 68 supports the weight of the grille 14 in a desired position with the upper edge 44 preferably located above a bottom 70 of the leg 56 so that it cannot be outwardly removed. In fact, it may be desirable for the upper surface 72 of the upper edge member 44 to contact the lower surface 74 of the cross member 60 in some embodiments.

With the grille 14 in a desired location, the security fasteners 76 may be installed relative to the lower edge member 48 and the bottom frame member 22. A spacer 78 may be located about a shaft 84 of fastener between lower edge members 48 and bottom frame member 22. The spacer 78 and/or shaft 84 may be painted OSHA yellow or other color. The spacer 78 may be a PVC or nylon spacer. The spacer 78 may alert emergency responding personnel as to where cuts can quickly be made to allow the grille 14 to be removed relative to the frame 12 for emergency access and/or fire fighting. Although the head of the fastener 76 is illustrated as having angled surfaces for being able to turn which could be the case particularly if the nut 82 is welded to the shaft 84 after installation, other constructions such as locking constructions may be provided. It is preferable for some embodiments that fastener 76 may not be removed without cutting through the sleeve 79 and the shaft 84 running through the sleeve 78. By maintaining the foot 68 in contact with the bottom frame member 22, the grille 14 does not then drop to the ground or the bottom frame member 22, but instead may then be relatively easily slid out of position by the emergency responding personnel off of the bottom frame member 22.

The mesh 52 or other grille construction such as expanded metal can be tack welded to the edge members 44,46,48,50 such as every two inches or otherwise securely connected 32 thereto.

Although the channel piece forming the top member 20 is shown, top member 20 could be any of the four members 16,18,20,22 of the frame 12 and it would be understood that the similarly connected fasteners 76 could be connected opposite the channel member. The applicant has found that this construction works particularly well in many applications. However, those of ordinary skill in the art would realize that other constructions could be possible for other embodiments.

By providing the glide bolts 62, when the emergency responding personnel such as a fire fighter cuts through the fasteners 76, the grille 12 does not drop down on the blade of the saw or cutting tool. Those of ordinary skill in the art will see that the fastener such as glide bolt 62 could facilitate supporting the grille 14 relative to the frame 12 while not pinching the saw during cutting.

In addition to providing a reflective surface as a portion, reflective and/or colored portion, the sleeve 68 could also be provided with shaft 84 and/or sleeve 78. Reflective tape or other material and/or paint could be utilized to facilitate identification of the cut points (i.e., the sleeves 78) in the dark. Two spaced apart fasteners 76 with sleeves 78 are believed to be sufficient for many embodiments with two feet 68. The feet 68 and fasteners 76 are symmetrically disposed relative to the grille 14 in this embodiment and the feet 68 are externally disposed relative to the fasteners 76 relative to a center axis of the grille 14 as shown Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A security grill and frame combination comprising:

a frame providing a perimeter, said frame having a front overhang on a first side which at least assists in defining a channel behind the overhang;

a grille extending at least partially into the channel with the channel preventing direct frontward removal of the grille at the overhang;

at least one adjustable length leg extending cantileveredly from the grille oppositely disposed on the grille relative to the overhang on a second side when installed, said adjustable length leg having a foot spaced by the leg from the grille contacting the perimeter opposite the overhang when installed; and at least one security fastener extending between the frame and the second side of the grille, said security fastener having a shaft accessible from the front when installed available to be cut by an emergency worker in the event of an emergency; and when cut, the grille is adapted to be removed from the front.

2. The security grille and frame combination of claim 1 wherein the first side is the top of the frame.

3. The security grille and frame combination of claim 1 further comprising a spacer extending about the shaft.

4. The security grille and frame combination of claim 3 wherein the spacer has a reflective outer surface.

5. The security grille and frame combination of claim 1 wherein the adjustable length leg terminates in a foot and the foot contacts the perimeter of the frame when installed thereby preventing the grille from moving significantly when the shaft is cut until the grille is removed by the emergency worker.

6. The security grille and frame combination of claim 5 wherein the first side is the top of the frame and the foot contacts a bottom of the frame.

7. The security grille and frame combination of claim 1 wherein the security fastener is screwed into a nut welded on a back of the frame.

8. The security grille and frame combination of claim 7 wherein the security fastener is directed into the nut through the frame.

9. The security grille and frame combination of claim 1 wherein the frame is connected to a building about a window.

10. The security grille and frame combination of claim 1 wherein the at least one leg further comprises at least two spaced apart legs.

11. The security grille and frame combination of claim 1 wherein the at least one security fastener comprises at least two spaced apart security fasteners.

12. The security grille and frame combination of claim 1 wherein the frame is formed of angle iron connected to a c-channel forming the first side.

13. The security grille and frame combination of claim 1 wherein the grille has edge members about a mesh, and the edge member at the second side is an angle iron which provides a surface for connecting to the at least one adjustable leg and at least one fastener.

14. A security grill and frame combination comprising:

a frame providing a perimeter, said frame having a front overhang on at a first side which at least assists in defining a channel behind the overhang;

a grille extending at least partially into the channel with the channel preventing direct frontward removal of the grille at the overhang; at least one adjustable length leg extending cantileveredly extending from the grille oppositely disposed on the grille relative to the overhang on a second side when installed;

at least one security fastener extending between the frame and the second side of the grille, said security fastener having a shaft accessible from the front when installed available to be cut by an emergency worker in the event of an emergency; and when cut, the grille is adapted to be removed from the front, and a spacer covering the shaft between the grille and the perimeter.

15. The security grille and frame combination of claim 14 wherein the spacer has a reflective exterior surface.

16. The security grille and frame combination of claim 14 further comprising said adjustable leg having a foot contacting the perimeter opposite the overhang when installed.

17. The security grille and frame combination of claim 14 wherein the frame is connected to a building about a window.

18. The security grille and frame combination of claim 14 wherein the adjustable length leg terminates in a foot and the foot contacts the perimeter of the frame when installed thereby preventing the grille from moving significantly when the shaft is cut until the grille is removed by the emergency worker.

19. The security grille and frame combination of claim 14 wherein the first side is the top of the frame.

20. The security grille and frame combination of claim 14 wherein the grille has edge members about a mesh, and the edge member at the second side is an angle iron which provides a surface for connecting to the at least one adjustable leg and at least one fastener, and the frame is formed of angle iron connected to a c-channel forming the first side.

* * * * *